US006962493B2

(12) United States Patent
Luo

(10) Patent No.: US 6,962,493 B2
(45) Date of Patent: Nov. 8, 2005

(54) SAFETY DISPOSABLE LIGHTER

(76) Inventor: Xing Wen Luo, 5100 Walnut Grove, Unit B, San Gabriel, CA (US) 91776

( * ) Notice: Subject to any disclaimer, the term of this patent is extended or adjusted under 35 U.S.C. 154(b) by 24 days.

(21) Appl. No.: 10/762,150

(22) Filed: Jan. 22, 2004

(65) Prior Publication Data

US 2005/0164140 A1 Jul. 28, 2005

(51) Int. Cl.[7] ..... F23Q 7/24
(52) U.S. Cl. ..... 431/153; 431/274; 431/277
(58) Field of Search ..... 431/153, 274, 431/276, 277; 131/329

(56) References Cited

U.S. PATENT DOCUMENTS 5,547,370 A * 8/1996 Hwang ..... 431/276
5,971,749 A * 10/1999 Chen ..... 431/153
5,997,281 A * 12/1999 Lei ..... 431/153
6,123,541 A * 9/2000 Yang ..... 431/153
6,352,429 B1 * 3/2002 Sher ..... 431/153
6,485,291 B2 * 11/2002 Adams ..... 431/153

* cited by examiner

*Primary Examiner*—Stephen Gravini
(74) *Attorney, Agent, or Firm*—Raymond Y. Chan; David and Raymond

(57) ABSTRACT

A lighter includes a shielding frame including a wind shielding guard and two safety guards integrally and rearwardly extended from two sidewalls of the wind shielding guard respectively. The shielding frame has a top ceiling and a top flame gate formed thereon to align with a gas nozzle, wherein the wind shielding guard has a height that a root portion of the lighter flame is positioned below the top flame gate for preventing the lighter frame from being blown out. Each safety guard has a top edge rim horizontally extended from the top ceiling of the wind shielding guard to a position above a top circumferential edge of the respective driving wheel, such that the safety guards form as a physical barrier for preventing a thumb of a child from fully engaging with the driving wheels to drive the striker wheel to rotate.

20 Claims, 4 Drawing Sheets

SAFETY DISPOSABLE LIGHTER

BACKGROUND OF THE PRESENT INVENTION

1. Field of Invention

The present invention relates to a lighter, and more particularly to a safety disposable lighter, which includes a heightened shielding frame for protecting a flame of the lighter from inference of wind and resisting undesired use of the lighter by children.

2. Description of Related Arts

Nowadays, U.S. government and U.S. Consumer Product Safety Commission demand a safety device in every cigarette lighter including the disposable lighter to prevent unwanted ignition accidentally or by a child. As it is known that the disposable lighter is common and relatively cheap, it is impossible to incorporate with expensive and complex safety device that highly increases the cost of the disposable lighter. In order to minimize the manufacturing cost of the disposable lighter employed with safety device, one of the most common safety disposable lighter is the driving wheel type disposable safety lighter. This type of disposable lighter comprises a pair of driving wheels for driving the striker wheel to rotate in order to generate sparks, wherein the driving wheels normally run idle when the driving wheels are physically disengaged with the striker wheel.

For example, U.S. Pat. No. 5,547,370, owned by Hwang, discloses a wheel axle mounted between two upright supports at the top of a butane wheel, two driving wheels mounted around the wheel axle and disposed in contact with a spring-supported flint below and turned by the driving wheels through the wheel axle to strike the spring-supported flint in producing sparks. The wheel axle is made of polygonal cross section, having two round rods at two opposite ends loosely inserted into a respective axle hole on each upright support so as to ensure a better connection between the striker wheel and the wheel axle.

Another example is U.S. Pat. No. 5,997,281, owned by Lei discloses two side thumb-wheel each having a circular shallow indentation are respectively mounted on two sides of a friction thumb-wheel, wherein each circular shallow indentation has an inner diameter slightly larger that an outside diameter of the friction thumb-wheel such that the friction thumb-wheel can be inserted into the circular shallow indentation. In such arrangement, when a pressing force is applied on the two side thumb-wheels, the side thumb-wheels will engage with the friction thumb-wheel, which in turn bears against a flint to create a spark.

However, most of the driving wheel type disposable safety lighters, including the above two patents, still have the following drawbacks.

Since the dimension of the driving wheels (side thumb-wheels) are not produced precisely for minimizing the manufacturing cost of the disposable lighter, there is always a clearance between the driving wheel and the striker wheel. The clearance is supposed to provide a gap that the driving wheels can rotate loosely around the axle in such a manner the driving wheels are run idle around the axle. However, the clearance also provides a gap that the driving wheels can axially loose such that the driving wheels may not perfectly engage with the striker wheel in order to provide an optimum mutual friction therebetween for ignition. Furthermore, in order to ignite the lighter, a downward force must be applied on the driving wheels for engaging the striker wheel. In fact, the driving wheels are always engaged with the striker wheel by gravity which acts as the downward force. In other words, the lighter, which claims as a safety lighter, may normally in a ready-to-ignite position.

Moreover, the manufacturing process of the conventional lighter is rather expensive and complicated. An extra process is needed to from an indentation on a side of the driving wheel. The circumferential surface of the indentation is serrated to provide frictional contact with the striker wheel, which is loosely fitted into the indentations of the driving wheels. An axle coaxially passing through the driving wheels and striker wheel is needed for rotatably mounting them onto a frame. In other words, the safety feature of the conventional lighters is achieved on the expenses of manufacturing costs and difficulties.

In addition to safety features, windproof is an area where much effort has been dedicated for a more effective lighter. A flame is composed of a main flame, the inner part, and a visible flame, the outer part. The main flame is a lot hotter than the viable flame, and is used for lighting a cigarette. A conventional lighter generally includes a shielding frame for protecting the main flame from interference by wind, and maintain the flame not extinguished. One of the considerations for designing the shielding frame is that its height must not block the operation of the driving wheels and striker wheel. As commonly observed, the shielding frame of conventional disposable light has a moderate height that exposes about one half of the driving wheel for purposes of effective operation. However, this height may not properly protect the main flame from interference of wind. Thus, the traditional disposable lighter is often troubled by undesired extinguishment of flame.

SUMMARY OF THE PRESENT INVENTION

A main object of the present invention is to provide a safety disposable lighter, which not only provides a windproof feature via the wind shielding guard to prevent the lighter flame from being blown out but also integrals with the child safety feature via the safety guards to prevent the safety disposable lighter from being ignited accidentally by child.

Another object of the present invention is to provide a safety disposable lighter, wherein the safety guards are integrally extended from the wind shielding guard to form a one piece integral shielding frame to achieve both windproof and childproof features in one single element, so as to simplify the structural design of the conventional lighter which requires two individual elements for respectively providing windproof and childproof features.

Another object of the present invention is to provide a safety disposable lighter, wherein the root portion of the lighter flame is protected by the wind shielding guard so as to prevent the lighter frame from being blown out accidentally, such as the interference of wind and unwanted extinguishment, while the adult user is still able to light up a cigarette by placing it at the flame gate of the wind shielding guard.

Another object of the present invention is to provide a safety disposable lighter, wherein the safety guards form as the wheel covering rims coaxially positioned at two outer side of the driving wheels to prevent the thumb of the child from fully engaging with the driving wheels in order to rotate the striker wheel for ignition. Therefore, only the adult user is sufficient to deform the thumb on the safety guards to contact with the driving wheels so as to drive the striker wheel to rotate for ignition.

Another object of the present invention is to provide a safety disposable lighter, wherein each of the safety guards has a wider corner rim to prevent the thumb of the child to keep engaging with the driving wheel so as to block up the rotational movement of the striker wheel for igniting the lighter.

Another object of the present invention is to provide a safety disposable lighter, wherein the shielding frame is adapted for incorporating with all kinds of lighter having a striker wheel so as to provide both the windproof and childproof features at the same time. In other words, the shielding frame does not require altering the original structural design of the lighter so as to minimize the manufacturing cost of incorporating the shielding frame with every conventional disposable lighter having the striker wheel.

Another object of the present invention is to provide a safety disposable lighter, wherein no expensive or complicate mechanical structure is required to employ in the present invention in order to achieve the above mentioned objects. Therefore, the present invention successfully provides an economic and efficient solution for providing both windproof and childproof configuration to the disposable lighter via the shielding frame.

Accordingly, in order to accomplish the above objects, the present invention provides a safety disposable lighter, comprising:

a gas casing having a liquefied gas cavity;

a supporting frame, which is sealedly mounted on the gas casing, comprising two supporting walls upwardly and parallelly extended from the supporting frame;

a gas valve having a gas nozzle upwardly extended from the supporting frame and communicating with the liquefied gas cavity;

a gas lever pivotally mounted between the supporting walls for actuating the gas valve to release gas from the liquefied gas cavity;

a flint supported by a resilient unit on the supporting frame at a position between the two supporting walls;

a striking wheel assembly comprising a striker wheel rotatably mounted between the supporting walls to frictionally contact with the flint, and two driving wheels, each having a diameter larger than a diameter of the striker wheel, coaxially mounted at two sides of the striker wheel respectively and arranged in such a manner that when the driving wheels are rotated, the striker wheel is driven to rotate and strike against the flint to produce sparks towards the gas nozzle so as to ignite the emitted gas; and a shielding frame, which is securely mounted on the supporting frame, comprising:

a U-shaped wind shielding guard having a top ceiling and a top flame gate formed thereon to align with the gas nozzle, wherein the wind shielding guard has a predetermined height that when the emitted gas is ignited to produce a lighter flame, a visible portion of the lighter frame is exposed to outside through the top flame gate while a root portion of the lighter flame is positioned below the top flame gate for preventing the lighter frame from being blown out; and a pair of safety guards integrally and rearwardly extended from two sidewalls of the wind shielding guard respectively and defined an ignition cavity between the two safety guards to rotatably receive the striking wheel assembly in the ignition cavity, wherein each of the safety guards has a top edge rim horizontally extended from the top ceiling of the wind shielding guard to a position above a top circumferential edge of the respective driving wheel, such that the safety guards form as a physical barrier for preventing a thumb of a child from fully engaging with the driving wheels to drive the striker wheel to rotate.

These and other objectives, features, and advantages of the present invention will become apparent from the following detailed description, the accompanying drawings, and the appended claims.

DETAILED DESCRIPTION OF THE PREFERRED EMBODIMENT

Figure 1:
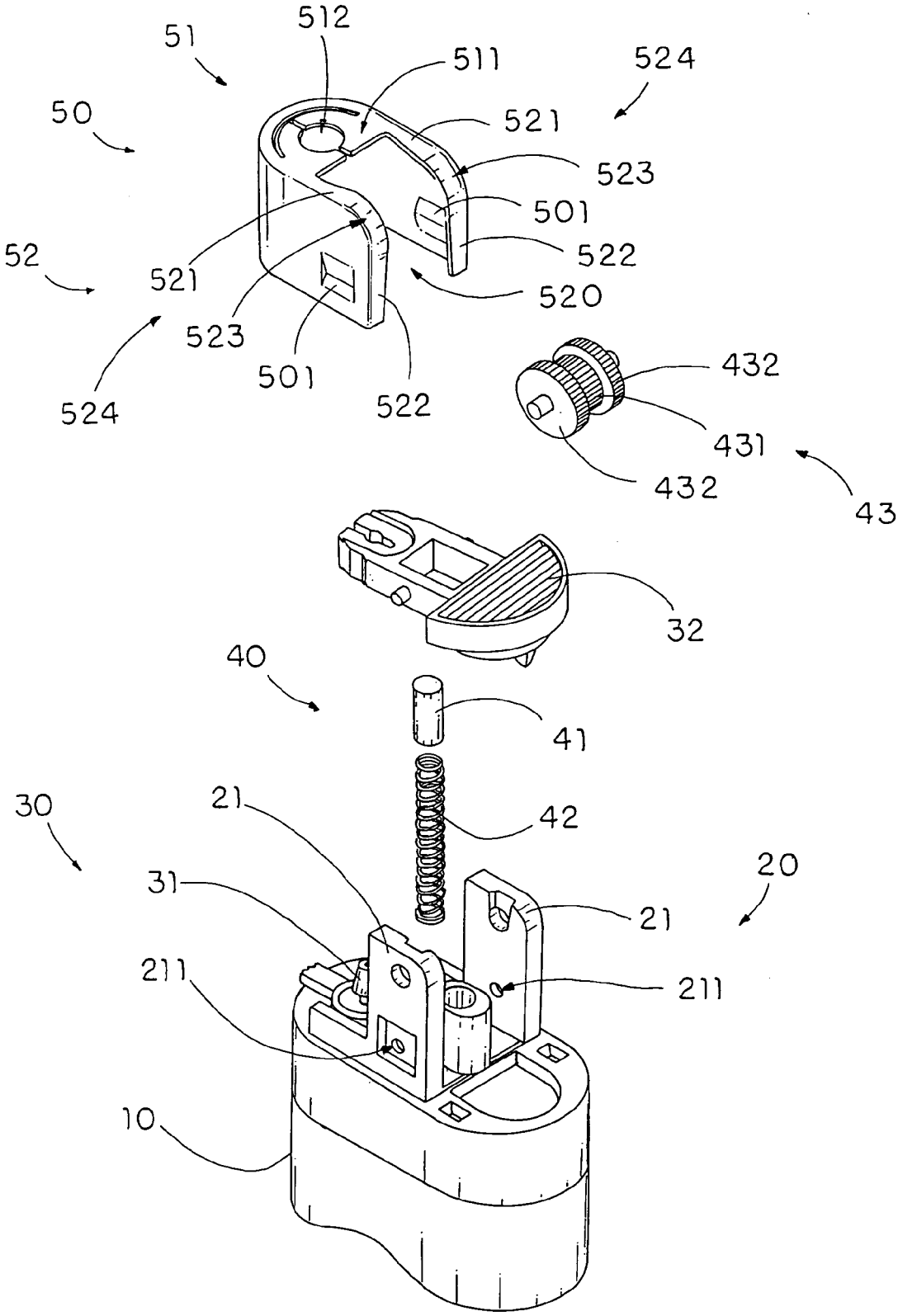
FIG. 1 is an exploded perspective view of a safety disposable lighter according to a preferred embodiment of the present invention.

Referring to FIG. 1 of the drawings, the safety disposable lighter 1 according to a preferred embodiment of the present invention is illustrated, wherein the safety disposable lighter comprises a gas casing 10 having a liquefied gas cavity 11, and a supporting frame 20, which is sealedly mounted on the gas casing 10, comprising two supporting walls 21 upwardly and parallelly extended from the supporting frame 20.

The safety disposable lighter further comprises a gas valve 30 having a gas nozzle 31 upwardly extended from the supporting frame 20 and communicating with the liquefied gas cavity 11 and a gas lever 32 pivotally mounted between the supporting walls 21 for actuating the gas nozzle 31 to release gas from the liquefied gas cavity 11.

The gas lever 32 is pivotally mounted on the supporting walls 21 by engaging wherein a first end of the gas lever 32 is engaged a neck of the gas valve 30 and a second end arranged when a downward pressing force is applied on the second end of the gas lever 32, the first end thereof is lifted up to release gas from the liquefied gas cavity 11 the gas nozzle 31.

An ignition unit 40 comprises a flint 41 by a resilient unit 42 on the supporting frame 20 at a position between the two supporting walls 21, and a striking wheel assembly 43 comprising a striker wheel 431 rotatably mounted between the supporting walls 21 to frictionally contact with the flint 41 and two driving wheels 432, each having a diameter larger than a diameter of the striker wheel 431, coaxially mounted at two sides of the striker wheel 431 respectively and arranged in such a manner that when the driving wheels 432 are rotated, the striker wheel 431 is driven to rotate and strike against the flint 41 to produce sparks towards the gas nozzle 31 so as to ignite the emitted gas.

Accordingly, the driving wheels 432 are securely attached to the two sides of the striker wheel 432 in such a manner that when the driving wheels 432 are driven to rotate, the striker wheel 431 rotates accordingly. The outer circumferential surfaces of the driving wheels 432 are serrated to create a frictional contact with a user's finger for helping the user to drive them to rotate. Likewise, the outer circumferential surface of the striker wheel 431 is also serrated to create a frictional contact with the flint 41, which is urged against the same by the resilient unit 42. Therefore, when the striking wheel assembly 43 is driven to rotate, the striker wheel 431 strikes against the flint 41 to generate sparks toward the gas nozzle 31 so as to ignite the emitted gas released from the gas nozzle 31 for producing a lighter flame.

The safety disposable lighter further comprises a shielding frame 50, which is securely mounted on the supporting frame 20, comprising a wind shielding guard 51 and a pair of safety guards 52.

Figure 2:
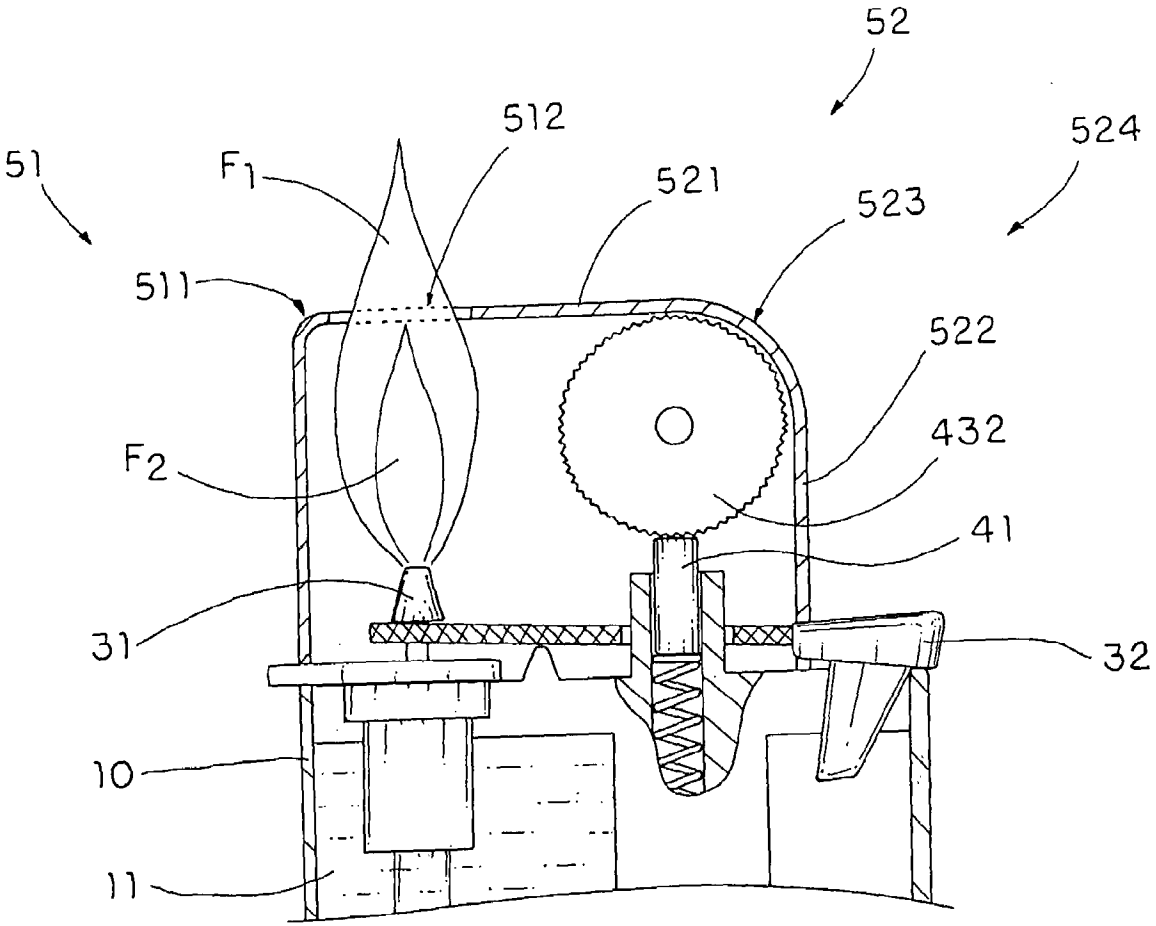
FIG. 2 is a sectional side view of the safety disposable lighter according to the preferred embodiment of the present invention.

The wind shielding guard 51, having a U-shaped cross section, has a top ceiling 511 and a top flame gate 512 formed thereon to align with the gas nozzle 31, wherein the wind shielding guard 51 has a predetermined height that when the emitted gas is ignited to produce a lighter flame, a visible portion F1 of the lighter frame is exposed to outside through the top flame gate 512 while a root portion F2 of the lighter frame is positioned below the top flame gate 512 for preventing the lighter frame from being blown out, as shown in FIG. 2.

The two safety guards 52 are integrally and rearwardly extended from two sidewalls of the wind shielding guard 51 respectively and defined an ignition cavity 520 between the two safety guards 52 to rotatably receive the striking wheel assembly 43 in the ignition cavity 520, wherein each of the safety guards 52 has a top edge rim 521 horizontally extended from the top ceiling 511 of the wind shielding guard 51 to position above a top circumferential edge of the respective driving wheel 432, such that the safety guards 52 forms as a physical barrier for preventing a thumb of a child from fully engaging with the driving wheels 432 to drive the striker wheel 431 to rotate.

As shown in FIG. 1, the shielding frame 50 further has two locking flanges 501 inwardly protruding from an inner side of the shielding frame 50 to align with the supporting walls 21 respectively, wherein each of the supporting walls 21 has a locking recess 211 engaging with the respective locking flange 501 so as to securely mount the shielding frame 50 on the supporting frame 20.

The lighter flame generally has the root portion F2 and the visible portion F1 surrounding the root portion F2. The temperature of root portion F2 of the lighter flame is substantially higher than that of the visible portion F1 of the lighter flame. As such, the root portion F2 of the lighter flame is the predominating role in lighting up a cigarette. In the preferred embodiment, the wind shielding guard 51 is heightened to an extent that a substantial part of the root portion F2 of the lighter flame is under the top ceiling 511 of the wind shielding guard 51 and a substantial part of the visible portion F1 of the lighter flame is exposed therefrom through the flame gate 512. Thus, the root portion F2 of the lighter flame is protected within the wind shielding guard 51 from interference of wind and unwanted extinguishment, while a user is still to light up a cigarette by placing it at the flame gate 512.

It is worth to mention that the size of the lighter flame is generally controlled by the flow of the gas emitted from the gas nozzle 31. The conventional disposable lighter is adapted to adjust the gas nozzle 31 via a gas regulator to reduce the flow of the gas such that the size of the lighter flame is minimized to remain the root portion of the lighter flame within the windshield. However, the lighter flame may easily be blown out since the flow of the gas is weak. Therefore, the wind shielding guard 51 of the shielding frame 50 allows a larger flow of gas emitted from the gas nozzle 31 to obtain a bigger size of the lighter flame while the root portion F2 of the lighter flame is retained within the wind shielding guard 51 to prevent the lighter flame from being blown out.

According to the preferred embodiment, the top edge rims 521 are integrally extended from the top ceiling 511 of the wind shielding guard 51 at two side edges of the flame gate 512 respectively to form a horizontal platform shelter to not only shelter the root portion F2 of the lighter flame within the wind shielding guard 51 for preventing the lighter flame from being blown out but also cover the top circumferential edges of the driving wheels 432 for preventing the driving wheels 432 from contacting with the thumb of the child.

As shown in FIG. 2, each of the safety guards 52 further has a rear edge rim 522 upwardly extended from the supporting frame 20 and a curved corner rim 523 integrally extended from the top edge rim 521 to the rear edge rim 522 to form an arc-shaped wheel covering rim 524 coaxially positioned at an outer side of the respective driving wheel 432.

A radius of each of the wheel covering rims 524 is slightly larger than a radius of the respective driving wheel 432 such that the driving wheels 432 are encircled by the wheel covering rims 524 respectively. In addition, a center of each of the wheel covering rims 524 is concentrically positioned at a center of the respective driving wheel 432.

According to the preferred embodiment, the rear edge rim 522 of each of the safety guards 52 is vertically extended from the supporting frame 20 at a position behind a rear circumferential edge of the respective driving wheel 432 such that at least a quarter of a circumference of the driving wheel 432 between the top and rear circumferential edges thereof is encircled by the respective wheel covering rim 524, as shown in FIG. 2.

Figure 3:
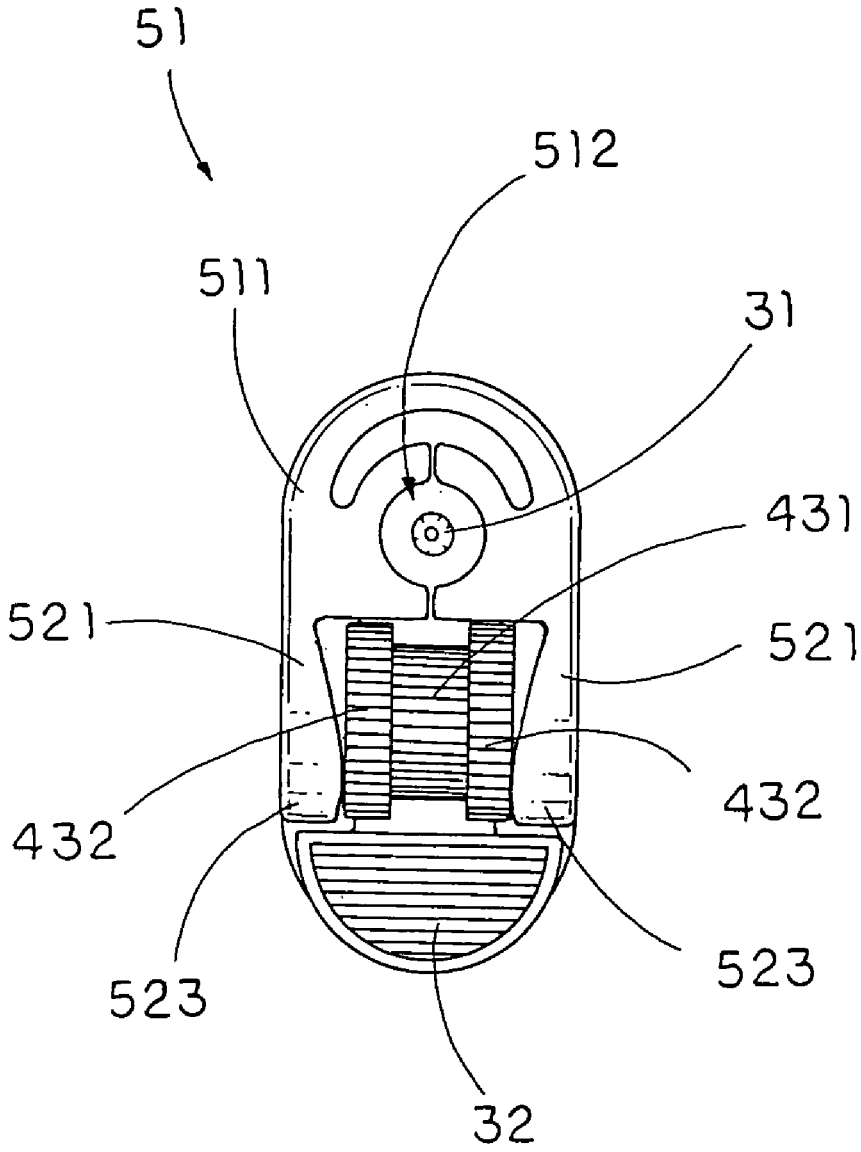
FIG. 3 is a top side view of the safety disposable lighter according to the above preferred embodiment of the present invention.

A width of the corner rim 523 of each of the safety guards 52 is larger than a width of the top edge rim 521 thereof for preventing the thumb of the child from contacting with the respective driving wheel 432, as shown in FIG. 3. Accordingly, in order to ignite the safety disposable lighter, the user must depress his or her thumb on the top edge rims 521 of the safety guards 52 into the ignition cavity 520 to contact with the driving wheels 432. Then, the user is able to rotate the driving wheels 432 to drive the striker wheel 431 to rotate while the thumb of the user must slide along the corner rims 523. However, the wider corner rims 523 form as two physical fences to prevent the thumb of the user to keep contacting with the driving wheels 432 unless the thumb of the user is big enough to keep the contact between the thumb and the driving wheels 432, which can prevent the safety disposable lighter from being ignited unintentionally. Therefore, the thumb of the child is insufficient to drive the driving wheels 432 at the corner rims 523 of the safety guards 52 so as to prevent the safety disposable lighter from being ignited accidentally by the child.

In addition, the wheel covering rim 524 of each of the safety guards 52 has a smooth rim surface for preventing the thumb of the child from driving the driving wheels 432 to rotate. Accordingly, the smooth rim surfaces of the wheel covering rims 524 minimize the friction between the thumb of the user and the wheel covering rims 524 such that the user must intentionally deform his or her thumb on the wheel covering rims 542 to contact with the driving wheels 432 so as to drive the driving wheels 432 and the striker wheel 431 to rotate. However, the child is unable to intentionally contact with the driving wheels 432 along the smooth rim surfaces of the wheel covering rims 524.

Therefore, the safety disposable lighter of the present invention not only provides a windproof feature via the wind shielding guard 51 to prevent the lighter flame from being blown out but also integrals with the child safety feature via the safety guards 52 to prevent the safety disposable lighter from being ignited accidentally by child.

Figure 4:
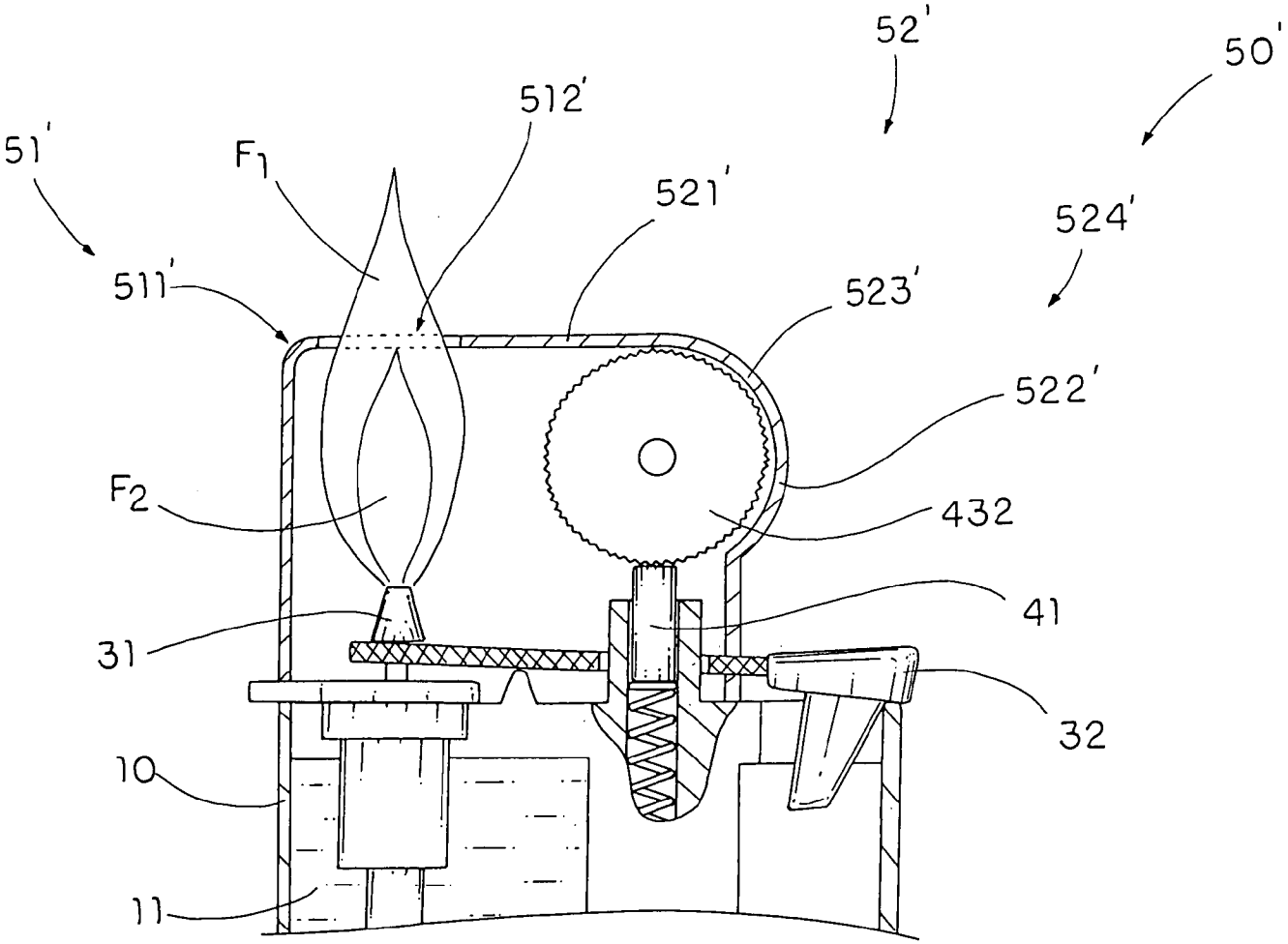
FIG. 4 illustrates an alternative mode of a shielding frame of the safety disposable lighter according to the above preferred embodiment of the present invention.

FIG. 4 illustrates an alternative mode of the shielding frame 50' which is securely mounted on the supporting frame 20, comprising a wind shielding guard 51' and a pair of safety guards 52'.

The wind shielding guard 51', having a U-shaped cross section, has a top ceiling 511' and a top flame gate 512' formed thereon to align with the gas nozzle 31', wherein the wind shielding guard 51' has a predetermined height that when the emitted gas is ignited to produce a lighter flame, a visible portion F1 of the lighter frame is exposed to outside through the top flame gate 512' while a root portion F2 of the lighter frame is positioned below the top flame gate 512' for preventing the lighter frame from being blown out, as shown in FIG. 4.

The two safety guards 52' are integrally and rearwardly extended from two sidewalls of the wind shielding guard 51' respectively and defined an ignition cavity 520' between the two safety guards 52' to rotatably receive the striking wheel assembly 43 in the ignition cavity 520', wherein each of the safety guards 52' has a top edge rim 521' horizontally extended from the top ceiling 511' of the wind shielding guard 51' to position above a top circumferential edge of the respective driving wheel 432, such that the safety guards 52' forms as a physical barrier for preventing a thumb of a child from fully engaging with the driving wheels 432 to drive the striker wheel 431 to rotate.

The top edge rims 521' are integrally extended from the top ceiling 511' of the wind shielding guard 51' at two side edges of the flame gate 512' respectively to form a horizontal platform shelter to not only shelter the root portion F2 of the lighter flame within the wind shielding guard 51' for preventing the lighter flame from being blown out but also cover the top circumferential edges of the driving wheels 432 for preventing the driving wheels 432 from contacting with the thumb of the child.

Each of the safety guards 52' further has a rear edge rim 522' upwardly extended from the supporting frame 20 and a curved corner rim 523' integrally extended from the top edge rim 521' to the rear edge rim 522' to form an arc-shaped wheel covering rim 524' coaxially positioned at an outer side of the respective driving wheel 432. A radius of each of the wheel covering rims 524' is slightly larger than a radius of the respective driving wheel 432 such that the driving wheels 432 are encircled by the wheel covering rims 524' respectively. A center of each of the wheel covering rims 524' is concentrically positioned at a center of the respective driving wheel 432.

Accordingly, each corner rim 523' of each of the safety guards 52' is rearwardly extended from the rear edge rim 522' thereof to form the wheel covering rims 524' having a semi-circular shape to encircle a rear circular portion of the respective driving wheel 432, as shown in FIG. 4. Therefore, more than a quarter of a circumference of the driving wheel 432 between the top and rear circumferential edges thereof is encircled by the respective wheel covering rim 524'.

In addition, a width of the corner rim 523' of each of the safety guards 52' is larger than a width of the top edge rim 521' thereof for preventing the thumb of the child from contacting with the respective driving wheel 432'. Therefore, the wider corner rims 523' form as two physical fences to prevent the thumb of the user to keep contacting with the driving wheels 432 unless the thumb of the user is big enough to keep the contact between the thumb and the driving wheels 432, which can prevent the safety disposable lighter from being ignited unintentionally. Furthermore, the thumb of the child is insufficient to drive the driving wheels 432 at the corner rims 523' of the safety guards 52' so as to prevent the safety disposable lighter from being ignited accidentally by the child.

One advantage of the disclosed invention is to achieve the functions of windproof and childproof, without incurring substantial increase-of costs. Most of the conventional childproof design is focused on the striking wheel assembly, which may be consisted of many parts, and may be assembled in a difficult way. In the disclosed invention, the integral windproof and childproof feature is achieved by heightened the shielding frame, and the striking wheel assembly can be any ones that simply include serrated driving wheels sandwiching a striker wheel. Because the cost of the simple-type striking wheel assembly is much lower than the complicated ones that may required many parts to be assembled together.

The disclosed lighter is even safer than many conventional types of childproof lighter, in terms of resisting the unwanted rotation of the striking wheel assembly by a child. For example, many of the conventional childproof lighters have a striking wheel assembly exposed out of the shielding frame, wherein a child may not have enough strength to drive the striking wheel assembly to rotate. However, a child may be able to drive the striking wheel assembly to rotate by holding the body of the lighter, and slide the striking wheel assembly against the floor to produce parks. According to the disclosed lighter, a child may not be able to produce sparks by this way, because the shielding frame is higher than the striking wheel assembly to avoid the contact between the assembly and floor.

The disclosed lighter is able to achieve the windproof and childproof features without a substantial change of the traditional manufacturing process. The shielding frame can be made by having a piece of metal punched with a mode. As long as its height is carefully calculated, the lighter can achieved the purposes of windproof and childproof features by the traditional manufacturing process literally non-changed. For a disposable lighter that is sold for only several dollars, the present invention is very cost-economical and performance-satisfying.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A safety disposable lighter, comprising:

a gas casing having a liquefied gas cavity;

a supporting frame, which is sealedly mounted on said gas casing, comprising two supporting walls upwardly and parallelly extended from said supporting frame;

a gas valve having a gas nozzle upwardly extended from said supporting frame and communicating with said liquefied gas cavity;

a gas lever pivotally mounted between said supporting walls for actuating said gas valve to release gas from said liquefied gas cavity;

a flint supported by a resilient unit on said supporting frame at a position between said two supporting walls;

a striking wheel assembly comprising a striker wheel rotatably mounted between said supporting walls to frictionally contact with said flint, and two driving wheels, each having a diameter larger than a diameter of said striker wheel, coaxially mounted at two sides of said striker wheel respectively and arranged in such a manner that when said driving wheels are rotated, said striker wheel is driven to rotate and strike against said flint to produce sparks towards said gas nozzle so as to ignite said emitted gas; and a shielding frame, which is securely mounted on said supporting frame, comprising:

a U-shaped wind shielding guard having a top ceiling and a top flame gate formed thereon to align with said gas nozzle, wherein said wind shielding guard has a predetermined height that when said emitted gas is ignited to produce a lighter flame, a visible portion of said lighter frame is exposed to outside through said top flame gate while a root portion of said lighter flame is positioned below said top flame gate for preventing said lighter frame from being blown out; and a pair of safety guards integrally and rearwardly extended from two sidewalls of said wind shielding guard respectively and defined an ignition cavity between said two safety guards to rotatably receive said striking wheel assembly in said ignition cavity, wherein each of said safety guards has a top edge rim horizontally extended from said top ceiling of said wind shielding guard to a position above a top circumferential edge of said respective driving wheel, such that said safety guards form as a physical barrier for preventing a thumb of a child from fully engaging with said driving wheels to drive said striker wheel to rotate.

2. The safety disposable lighter, as recited in claim 1, wherein said top edge rims are integrally extended from said top ceiling of said wind shielding guard at two side edges of said flame gate respectively to form a horizontal platform shelter to not only shelter said root portion of said lighter flame within said wind shielding guard for preventing said lighter flame from being blown out but also cover said top circumferential edges of said driving wheels for preventing said driving wheels from contacting with said thumb of said child.

3. The safety disposable lighter, as recited in claim 1, wherein each of said safety guards further has a rear edge rim upwardly extended from said supporting frame and a curved corner rim integrally extended from said top edge rim to said rear edge rim to form an arc-shaped wheel covering rim coaxially positioned at an outer side said respective driving wheel, wherein a radius of each of said wheel covering rims is slightly larger than a radius of said respective driving wheel such that said driving wheels are encircled by said wheel covering rims respectively.

4. The safety disposable lighter, as recited in claim 2, wherein each of said safety guards further has a rear edge rim upwardly extended from said supporting frame and a curved corner rim integrally extended from said top edge rim to said rear edge rim to form an arc-shaped wheel covering rim coaxially positioned at an outer side said respective driving wheel, wherein a radius of each of said wheel covering rims is slightly larger than a radius of said respective driving wheel such that said driving wheels are encircled by said wheel covering rims respectively.

5. The safety disposable lighter, as recited in claim 3, wherein said rear edge rim is vertically extended from said supporting frame at a position behind a rear circumferential edge of said respective driving wheel such that at least a quarter of a circumference of said driving wheel between said top circumferential edge and said rear circumferential edge thereof is encircled by said respective wheel covering rim.

6. The safety disposable lighter, as recited in claim 4, wherein said rear edge rim is vertically extended from said supporting frame at a position behind a rear circumferential edge of said respective driving wheel such that at least a quarter of a circumference of said driving wheel between said top circumferential edge and said rear circumferential edge thereof is encircled by said respective wheel covering rim.

7. The safety disposable lighter, as recited in claim 3, wherein each said corner rim of each of said safety guards is rearwardly extended from said rear edge rim thereof to form said wheel covering rims having a semi-circular shape to encircle a rear circular portion of the respective driving wheel, such that at least a quarter of a circumference of said driving wheel between said top circumferential edge and a rear circumferential edge thereof is encircled by said respective wheel covering rim.

8. The safety disposable lighter, as recited in claim 4, wherein each said corner rim of each of said safety guards is rearwardly extended from said rear edge rim thereof to form said wheel covering rims having a semi-circular shape to encircle a rear circular portion of the respective driving wheel, such that at least a quarter of a circumference of said driving wheel between said top circumferential edge and a rear circumferential edge thereof is encircled by said respective wheel covering rim.

9. The safety disposable lighter, as recited in claim 3, wherein a width of said corner rim of each of said safety guards is larger than a width of said top edge rim thereof for preventing said thumb of said child from contacting with said respective driving wheel.

10. The safety disposable lighter, as recited in claim 4, wherein a width of said corner rim of each of said safety guards is larger than a width of said top edge rim thereof for preventing said thumb of said child from contacting with said respective driving wheel.

11. The safety disposable lighter, as recited in claim 6, wherein a width of said corner rim of each of said safety guards is larger than a width of said top edge rim thereof for preventing said thumb of said child from contacting with said respective driving wheel.

12. The safety disposable lighter, as recited in claim 8, wherein a width of said corner rim of each of said safety guards is larger than a width of said top edge rim thereof for preventing said thumb of said child from contacting with said respective driving wheel.

13. The safety disposable lighter, as recited in claim 6, wherein said wheel covering rim of each of said safety guards has a smooth rim surface for preventing said thumb of said child from driving said driving wheels to rotate.

14. The safety disposable lighter, as recited in claim 8, wherein said wheel covering rim of each of said safety guards has a smooth rim surface for preventing said thumb of said child from driving said driving wheels to rotate.

15. The safety disposable lighter, as recited in claim 11, wherein said wheel covering rim of each of said safety guards has a smooth rim surface for preventing said thumb of said child from driving said driving wheels to rotate.

16. The safety disposable lighter, as recited in claim 12, wherein said wheel covering rim of each of said safety guards has a smooth rim surface for preventing said thumb of said child from driving said driving wheels to rotate.

17. The safety disposable lighter, as recited in claim 6, wherein a center of each of said wheel covering rims is concentrically positioned at a center of said respective driving wheel.

18. The safety disposable lighter, as recited in claim 8, wherein a center of each of said wheel covering rims is concentrically positioned at a center of said respective driving wheel.

19. The safety disposable lighter, as recited in claim 15, wherein a center of each of said wheel covering rims is concentrically positioned at a center of said respective driving wheel.

20. The safety disposable lighter, as recited in claim 16, wherein a center of each of said wheel covering rims is concentrically positioned at a center of said respective driving wheel.

* * * * *